US009514725B1

(12) United States Patent
Brandstetter et al.

(10) Patent No.: US 9,514,725 B1
(45) Date of Patent: Dec. 6, 2016

(54) MUSICAL INSTRUMENT

(71) Applicant: Joseph A. Brandstetter, Palmdale, CA (US)

(72) Inventors: Joseph Abraham Brandstetter, Palmdale, CA (US); Richard Yale Boemer, Huntington Beach, CA (US); Jacob Lee Simpson, Crocker, CA (US); Harold B. Rhodes, Woodland Hills, CA (US)

(73) Assignee: Joseph A. Brandstetter, Palmdale, CA (US)

( * ) Notice: Subject to any disclaimer, the term of this patent is extended or adjusted under 35 U.S.C. 154(b) by 0 days.

(21) Appl. No.: 14/815,885

(22) Filed: Jul. 31, 2015

(51) Int. Cl.
*G10H 3/14* (2006.01)
*G10H 3/12* (2006.01)

(52) U.S. Cl.
CPC ..... *G10H 3/12* (2013.01); *G10H 2220/221* (2013.01)

(58) Field of Classification Search
CPC ..... G10H 3/14; G10H 3/16; G10H 3/20
USPC ..... 84/725, 727, 729
See application file for complete search history.

(56) References Cited

U.S. PATENT DOCUMENTS

| | | | | |
|---|---|---|---|---|
| 149,232 A | | 3/1874 | Lincoln | |
| 967,015 A | | 8/1910 | Gilmore | |
| 1,269,511 A | | 6/1918 | Roberge | |
| 1,791,720 A | | 2/1931 | Exter | |
| 1,963,719 A | | 6/1934 | Schelkunoff | |
| 2,155,741 A | | 4/1939 | Severy | |
| 2,214,112 A | | 9/1940 | Schulze | |
| 2,318,936 A | | 5/1943 | Fisher | |
| 2,456,321 A | * | 12/1948 | Rhodes | G10C 3/26 84/237 |
| 2,469,667 A | | 5/1949 | Burroughs | |
| 2,492,919 A | | 12/1949 | Hings | |
| 2,502,339 A | * | 3/1950 | Perreault | H01H 51/34 200/245 |
| 2,510,094 A | | 6/1950 | Fleury | |
| 2,588,295 A | | 3/1952 | Rowe | |
| 2,641,153 A | | 6/1953 | Brown | |
| 2,647,949 A | | 8/1953 | Burns | |
| 2,755,697 A | | 7/1956 | Miessner | |
| 2,765,693 A | | 10/1956 | Link | |
| 2,834,243 A | * | 5/1958 | Miessner | G10H 3/20 84/408 |

(Continued)

OTHER PUBLICATIONS

M. Muenster and F. Pfeifle, "Non-Linear Behaviour in Sound Production of the Rhodes Piano", ISMA 2014.

*Primary Examiner* — David Warren
(74) *Attorney, Agent, or Firm* — Knobbe, Martens, Olson & Bear LLP

(57) ABSTRACT

Disclosed in certain arrangements is a musical instrument that can include a plurality of tine tone generators. The musical instrument can include a keyboard including a plurality of keys. The plurality of tine tone generators can be configured to correspond with one of each of the plurality of tine tone generators. The musical instrument can also include a plurality of hammers, wherein each of the plurality of hammers is configured to strike one of the plurality of tine tone generators when one of the plurality of keys is depressed. The tine tone generator can be configured to form a single unitary piece and can include a tone bar and a tine. The tine can further include a tuning spring and can include a ferro magnetic tip.

26 Claims, 11 Drawing Sheets

(56) References Cited

U.S. PATENT DOCUMENTS 2,905,039 A * 9/1959 Alvarez ..... G10H 3/20 84/729
2,972,922 A * 2/1961 Rhodes ..... G10H 3/20 84/402
3,270,608 A * 9/1966 Rhodes ..... G10D 13/085 84/237
3,285,116 A * 11/1966 Rhodes ..... G10H 1/32 84/176
3,384,699 A * 5/1968 Rhodes ..... G10D 13/085 84/409
3,418,417 A * 12/1968 Rhodes ..... G10H 3/20 84/743
3,437,850 A * 4/1969 Bunger ..... G10H 3/20 310/321
3,480,808 A 11/1969 Rieth
3,644,656 A * 2/1972 Fender ..... G10H 3/20 84/404
3,919,910 A 11/1975 Rust
4,040,321 A * 8/1977 Lover ..... G10H 3/20 381/118
4,050,341 A 9/1977 Underwood
4,205,583 A * 6/1980 Absmann ..... G10C 3/125 84/430
4,324,164 A * 4/1982 Monte ..... G10C 3/26 84/34
4,338,848 A * 7/1982 Rhodes ..... G10H 3/20 84/253
4,342,246 A * 8/1982 Rhodes ..... G10H 3/20 84/725
4,373,418 A * 2/1983 Rhodes ..... G10H 3/20 84/404
4,433,602 A * 2/1984 de Vries ..... G10H 3/20 84/236
5,003,859 A * 4/1991 Monte ..... G10H 1/346 84/423 R
5,115,705 A * 5/1992 Monte ..... G10H 1/182 338/69
7,528,311 B2 5/2009 Terada
7,642,437 B2 1/2010 Terada
7,804,014 B2 9/2010 Terada
7,839,269 B2 * 11/2010 Steger ..... A63B 71/0686 340/407.1
8,067,685 B2 * 11/2011 Parish ..... G10C 3/06 84/173
8,093,995 B2 * 1/2012 Steger ..... A63B 71/0686 340/407.1
8,378,795 B2 * 2/2013 Steger ..... A63B 71/0686 340/407.1
9,035,160 B2 * 5/2015 Rapp ..... G10H 3/125 84/104
2003/0196542 A1 * 10/2003 Harrison, Jr. ..... G04B 25/00 84/737
2007/0000375 A1 * 1/2007 Harrison, Jr. ..... G04B 25/00 84/737
2007/0137458 A1 6/2007 Terada
2009/0153350 A1 * 6/2009 Steger ..... A63B 71/0686 340/4.2
2011/0121954 A1 * 5/2011 Steger ..... A63B 71/0686 340/407.1
2012/0126960 A1 * 5/2012 Steger ..... A63B 71/0686 340/407.1
2013/0152768 A1 * 6/2013 Rapp ..... G10H 3/125 84/634
2015/0262558 A1 * 9/2015 Trinca ..... A63H 33/30 84/184
2015/0287395 A1 * 10/2015 Rapp ..... G10H 3/125 84/422.1

* cited by examiner

MUSICAL INSTRUMENT

FIELD OF THE DISCLOSURE

The present disclosure relates to musical instruments. More specifically certain aspects of the present disclosure relate to an electro-mechanical piano with a tine tone generators.

BACKGROUND

U.S. Pat. No. 3,418,417 describes an electro-mechanical piano that uses of a vibrating tine mounted on a tone bars to form an asymmetric tuning fork. The electro-mechanical piano generates sound using keys and hammers in the same manner as an acoustic piano. However, unlike an acoustic piano, the hammer strikes thin rods (e.g. tines) of varied length, connected to tone bars. When hit by a piano hammer, the tine vibrates at a particular pitch. This vibration is picked up by an electro-magnetic coil that is mounted adjacent to the tip of the tine. The electrical signal is amplified and played out through a speaker. As the tine is lengthened or shortened, the pitch of the note changes. The lengths of the tines and tone bars can be varied to cover the full range of an 88 note piano.

SUMMARY

In one embodiment, a plurality of tine tone generators are configured for use within an electro-mechanical piano. The components of each of the tine tone generators are configured to minimize distortion and unwanted overtones. In embodiments, the configuration of the tine tone generator can maintain the integrity of the tune of the particular tine tone generator. In one embodiment, the tine tone generator comprises a tone bar and a tine. In one embodiment, the tine is made of titanium. In one embodiment, the tone bar is made of aluminum. In one embodiment the tine is made entirely of titanium. In one embodiment, the tine is a monolithic piece of titanium. In one embodiment, the tone bar is entirely made of aluminum. In one embodiment, the tone bar is monolithic piece of aluminum.

In one embodiment, disclosed is a musical instrument that can include a keyboard, wherein the keyboard includes a plurality of keys across more than one octave. In some embodiments, the musical instrument can include a plurality of tine tone generators, wherein each of the plurality of tine tone generators comprises a tone bar and a tine, wherein the tone bar is composed a single unitary piece, and wherein each of the plurality of keys correspond with one of each of the plurality of tine tone generators, each of the tone bars comprising distal portion having a length and a constant cross-sectional shape along the length of the distal portion, and across more than one octave the distal portions of the tone bar have the same cross-sectional shape. In some embodiments, the musical instrument can include a plurality of hammers, wherein each of the plurality of hammers is configured to strike the tine of one of the plurality of tine tone generators when one of the plurality of keys is depressed.

In some embodiments, the tine tone generator of the musical instrument can include a tine that can be made of a first material and the tone bar can be made of a second material that is different than the first material. In some embodiments, the tine can be composed of a titanium alloy. In some embodiments, the tone bar can be composed of aluminum.

In some embodiments, the tine of the musical instrument can include a tuning spring disposed about the tine.

In some embodiments, the musical instrument can further include a pickup.

In some embodiments, the musical instrument can further include a microphone.

In some embodiments, the musical instrument can further include an amplifier. In some embodiments, the amplifier can be a speaker or guitar amplifier. In some embodiments, the amplifier can be an acoustic chamber. In some embodiments, the musical instrument can further include a carbon sound chamber and a driver.

In one embodiment, disclosed is a tine tone generator for an electric piano including a tone bar, wherein the tone bar includes a proximal portion for connecting the tone bar to a support surface, a generator portion that extends substantially perpendicularly from the bottom surface of the proximal portion, and distal portion extending distally from the proximal portion at a first angle and then bending to extend distally in a second direction. IN some embodiments, the musical instrument can further include a tine that extends distally from a surface of the generator portion in a third direction that is substantially parallel to the second direction.

In some embodiments, the tine tone generator can further include a tuning spring, wherein the tuning spring is formed from coiled wire and is disposed about an outer surface of the tine.

In some embodiments, the tine of the tine tone generator can include a magnetic tip at the end of the tine.

In some embodiments, the tine of the tine tone generator can be composed of a titanium alloy.

In some embodiments, the tone bar of the tine tone generator can be composed of aluminum.

In some embodiments, the tone bar of the tine tone generator can include a 45 degree angle bend.

In some embodiments, the tine of the tine tone generator can include a taper where the tine is attached to the generator.

In some embodiments, the tone bar of the tine tone generator can have a uniform thickness of ⅜ of an inch.

In some embodiments, the tone bar of the tine tone generator can extend past the tine.

In one embodiments, disclosed is an electrical musical instrument, comprising a tone bar made from aluminum, a tine made form titanium and being in tune with the tone bar and comprising a ferro magnetic tip, and a pick-up comprising a magnet and a coil, the pick-up operatively associated with tip of the tine to produce an electrical signal which determined by the vibration of the tine.

In one embodiment, disclosed is a tine for an electromechanical piano of the type in which a tone is generated by striking a tine, and the resulting vibrations of the tine are transduced into a voltage, the tine comprising a distal cylindrical portion and larger diameter proximal portion and a tapered portion between the distal cylindrical portion and the larger diameter proximal portion.

In some embodiments, the larger diameter proximal portion of the tine can be cylindrical.

In some embodiments, the tapered portion of the tine can have a curved radius that is greater than 1.5 inches.

In some embodiments, the tine can be formed of a non-magnetic material.

In some embodiments, the tine can further comprise a ferro magnetic tip

In some embodiments, the tine can be made of titanium.

In one embodiment, disclosed is an electromechanical piano incorporating both vibratory device and electronic device to generate the desired sounds, said piano comprising a plurality of keys. In some embodiments, the electromechanical piano further includes a plurality of hammers, each hammer associated with at least one key. In some embodiments, the electromechanical piano further includes a plurality of tines associated with at least one hammer that is associated with at least one key, each tine configured to vibrate in response to striking of a portion thereof by an associated hammer, each tine having a longitudinal axis. In some embodiments, the electromechanical piano further includes a linkage that causes an associated hammer to strike an associated tine in response to striking associated key. In some embodiments, the electromechanical piano further includes a plurality of tone bars, each tone bar coupled one of the plurality of tines, each of the plurality of tone bars comprising a proximal portion, a generator portion, a angled portion, and a distal portion, the proximal portion having a longitudinal axis extending substantially parallel to the longitudinal axis of the tine and branching off in a distal direction into the generator portion and the angled portion, the angled portion extending upwardly at first angle with respect to the longitudinal axis of the proximal portion, the generator portion extending away from the angled portion at an angle substantially perpendicular to the longitudinal axis of the proximal portion, and the distal portion extending distally from the angled portion along a longitudinal axis that is substantially parallel to the longitudinal axis of the tine.

In some embodiments, the first angle of the electromechanical piano can be between 30 and 60 degrees. In some embodiments, the first angle of the electromechanical piano can be 45 degrees.

In some embodiments, the proximal portion, angled portion, generator portion and distal portion of the electromechanical piano can form a monolithic piece of material. In some embodiments the monolithic piece of material can be aluminum.

In some embodiments, the proximal portion, angled portion, generator portion and distal portion of the electromechanical piano can have a constant cross-section. In some embodiments, the cross-section can be square.

In one embodiment, disclosed is a tone bar for an electromechanical piano of the type in which a tone is generated by striking a lower mass tine which is coupled to the tone bar, and the resulting vibrations of the struck tine are transduced into a voltage adapted to be amplified and used to drive a loudspeaker, the tone bar comprising a proximal portion, a generator portion, an angled portion, and a distal portion, the proximal portion having a longitudinal axis extending substantially parallel to the longitudinal axis of the tine and branching off in a distal direction into the generator portion and the angled portion, the angled portion extending away from the longitudinal axis of the proximal portion at first angle with respect to the longitudinal axis of the proximal portion, the generator portion extending away from the longitudinal axis of eth proximal portion at an angle substantially perpendicular to the longitudinal axis of the proximal portion, and the distal portion extending distally from the angled portion along a longitudinal axis that is substantially parallel to the longitudinal axis of the tine.

In one embodiment, disclosed is an electrical musical instrument, comprising: a tone bar. In some embodiments, the disclosed electrical musical instrument can further comprise a sound chamber. In some embodiments, the disclosed electrical musical instrument can further comprise a tine comprising a ferro magnetic portion. In some embodiments, the disclosed electrical musical instrument can further comprise a pick-up comprising a magnet and a coil, the pick-up operatively associated with tip of the tine to produce an electrical signal which determined by the vibration of the tine. In some embodiments, the disclosed electrical musical instrument can further comprise a driver operatively connected to the pick-up, the driver configured to vibrate in response to the electrical signal produced by the pick-up, the driver coupled to the sound chamber to transmit vibrations to the sound chamber.

In one embodiment, disclosed is a musical instrument, comprising a keyboard, wherein the keyboard includes a plurality of keys. In some embodiments, the disclosed musical instrument can further comprise a plurality of tine tone generators, wherein each of the plurality of tine tone generators comprises a tone bar and a tine, wherein each of the plurality of keys correspond with one of each of the plurality of tine tone generators. In some embodiments, the disclosed musical instrument can further comprise a plurality of hammers, wherein each of the plurality of hammers is configured to strike a corresponding tine of one of the plurality of tine tone generators when one of the plurality of keys is depressed, wherein when one of the plurality of hammers strikes a corresponding tine, the audible sound generated from the musical instrument 25% to 150% longer than a corresponding note on a standard piano.

In one embodiment, disclosed is a musical instrument, comprising a keyboard, wherein the keyboard includes a plurality of keys. In some embodiments, the disclosed musical instrument can further comprise a plurality of tine tone generators, wherein each of the plurality of tine tone generators comprises a tone bar and a tine, wherein each of the plurality of keys correspond with one of each of the plurality of tine tone generators. In some embodiments, the disclosed musical instrument can further comprise a plurality of hammers, wherein each of the plurality of hammers is configured to strike a corresponding tine of one of the plurality of tine tone generators when one of the plurality of keys is depressed, wherein when one of the plurality of hammers strikes a corresponding tine, the sound generated by the musical instrument decays along a best fit line and in which decibel oscillations from the best fit of the decay are less than 1 to 5% decibels from line of best fit of the decibel decay.

For purposes of summarizing the invention and the advantages achieved over the prior art, certain objects and advantages of the invention have been described in this application. It is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the embodiments having reference to the attached figures, the invention not being limited to any particular embodiment(s) disclosed.

BRIEF DESCRIPTION OF THE DRAWINGS

Exemplary embodiments are illustrated in the accompanying drawings, which are for illustrative purposes only. The drawings comprise the following figures, in which like numerals indicate like parts.

DETAILED DESCRIPTION OF THE PREFERRED EMBODIMENTS

Figure 1:
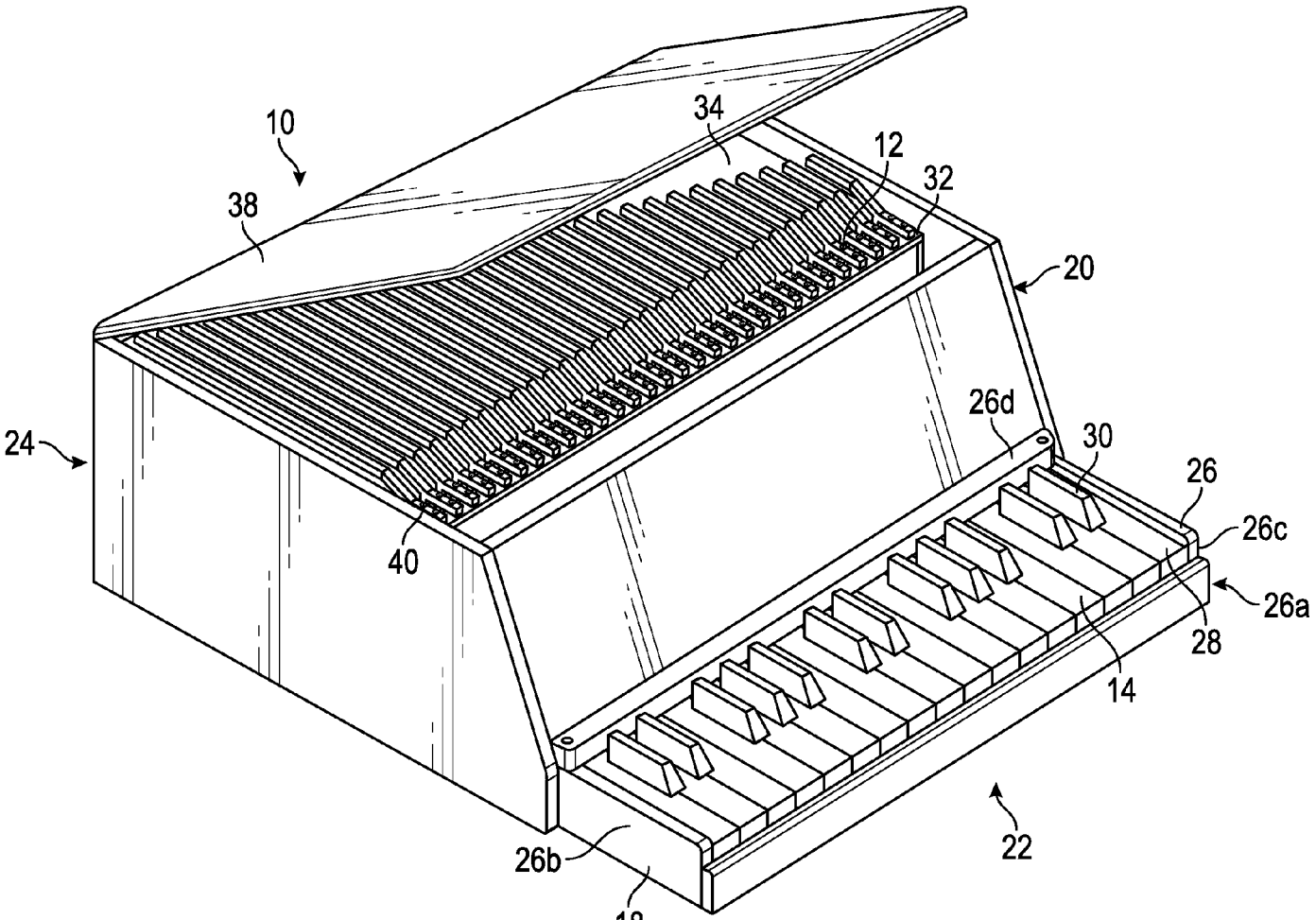
FIG. 1 is a top perspective view of an electro-mechanical piano that includes a plurality of tine tone generators.

Although the invention has been disclosed in the context of certain embodiments and examples, it will be understood by those skilled in the art that the invention extends beyond the specifically disclosed embodiments to other alternative embodiments and/or uses and obvious modifications and equivalents thereof. Accordingly, the invention is not intended to be limited by the specific disclosures of embodiments herein. Thus, the scope of the claims appended hereto is not limited by any of the particular embodiments described herein. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components. For purposes of comparing various embodiments and arrangements, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

Certain terminology may be used in the following description for the purpose of reference only, and thus are not intended to be limiting. For example, terms such as "above" and "below" refer to directions in the drawings to which reference is made. Terms such as "proximal," "distal," "front," "back," "rear," and "side" describe the orientation and/or location of portions of the components or elements within a consistent but arbitrary frame of reference which is made clear by reference to the text and the associated drawings describing the components or elements under discussion. Such terminology may include the words specifically mentioned above, derivatives thereof, and words of similar import. As used herein, the term "proximal" refers to the parts of the device and system which are located closer to one side of a device and system. The term "distal" refers to the parts of the device and system which are located further from proximal side of the device and system (e.g., clinician) and generally.

In certain disclosed embodiments, there is a tine tone generator that can be configured for use in a piano such as an electro-mechanical piano. The tine tone generator can be composed of a tone bar and a tine. As will be described below, the configuration of the tine tone generator can allow the tine tone generator to behave similar to a tuning fork and emit a pure tone with very little overtone. The attachment between the tine and the tone bar can be configured to allow an improved transfer of vibration from the tine into the tone bar.

In addition to the configuration of the tine tone generator, the individual components (e.g., the tone bar and/or tine) can be configured to reduce the amount of distortion and overtones present in the tone produced. For example, in certain embodiments, as will be discussed below, the tine can be composed of material and/or a shape that can allow the tine to vibrate in a controlled manner. In certain embodiments, the tone bar can be composed of material with sufficient strength to sustain and increase the longevity of the note produced and/or can have a shape that can also enhance the note produced.

FIG. 1 illustrates a top perspective view of an embodiment of an electro-mechanical piano 10 that includes a plurality of tine tone generators 12 of differing lengths. The electro-mechanical piano 10 can include a base frame 18 and a case 20. In some examples, as illustrated in FIG. 1, the base frame 18 can be configured to retain the keys while the case 20 retains the plurality of tine tone generators 12. As will be discussed below, the keys can extend from the proximal end 22 of the electro-mechanical piano 10 to the distal end 24 such that the keys extend through the base of the case 20. As is further illustrated in FIG. 2, the distal end of each of the keys can be configured to interact with one of a plurality of hammers (pictured in FIG. 2). As a musician depresses one of the plurality keys, it can cause the hammer to strike one of the plurality of tine tone generators 12 to produce a sound corresponding to the key.

The base frame 18 illustrated in FIG. 1 is located at the base of the electro-mechanical piano 10 and extends from the proximal end of the case 20. The base frame 18 can be generally flat so as to allow a plurality of keys 14—white keys 28 and black keys 30—to be aligned adjacent to each other across the top surface of the base frame 18. The electro-mechanical piano 10 illustrated in FIG. 2 includes 28 keys, however the electro-mechanical piano 10 can be configured to accommodate any number of keys—for example, the 61 or 76 keys of a standard keyboard or the 88 keys of a standard piano.

The plurality of keys 14 can be aligned such that the proximal end of the keys 14 are aligned with the proximal end of the base frame 18. In some examples, the plurality of keys 14 are retained in the proximal end of the electro-mechanical piano 10 by a guard 26. In some embodiments, the guard 26 has a rectangular form and has a front end 26*a*, a left end 26*b*, and a right end 26*c* that can be configured to maintain the alignment of the proximal end of the white keys 28 on the proximal end of the base frame 18. The guard 26 can further include a back end 26*d* that is disposed about the top surface of the white keys 28 such that the proximal end of the back end 26*d* lies flush against the distal end of each of the black keys 30. This back end 26*d* can therefore be configured to prevent the distal movement of any of the key 14.

As mentioned above, in some examples, the electro-mechanical piano 10 can include a case 20 that retains the plurality of tine tone generators 12. In some examples, the case 20 can include a lid 38 that closes over the top of the case 20. The plurality of tine tone generator 12 can be arranged in descending order such that the notes increase in octaves as the key 14 are played from left to right. Each of the tine tone generators 12 can be disposed between a proximal cross member 32 and a distal cross member 34. In some embodiments, each of the plurality of tine tone generator 12 can be retained against the proximal cross member 32 by a plurality of nails 40 that extend through the plurality of holes 36 of each of the tine tone generator 12.

Each of the tine tone generators 12 can correspond to at least one of the keys 14. To produce a range of tones, each of the plurality of tine tone generators 12 can have a tone bar of a different length. As will be discussed further below, the case 20 of the electro-mechanical piano 10 can further retain a plurality of hammers that are configured to strike one of the plurality of tine tone generators 12 when one of the keys 14 are depressed.

Figure 2:
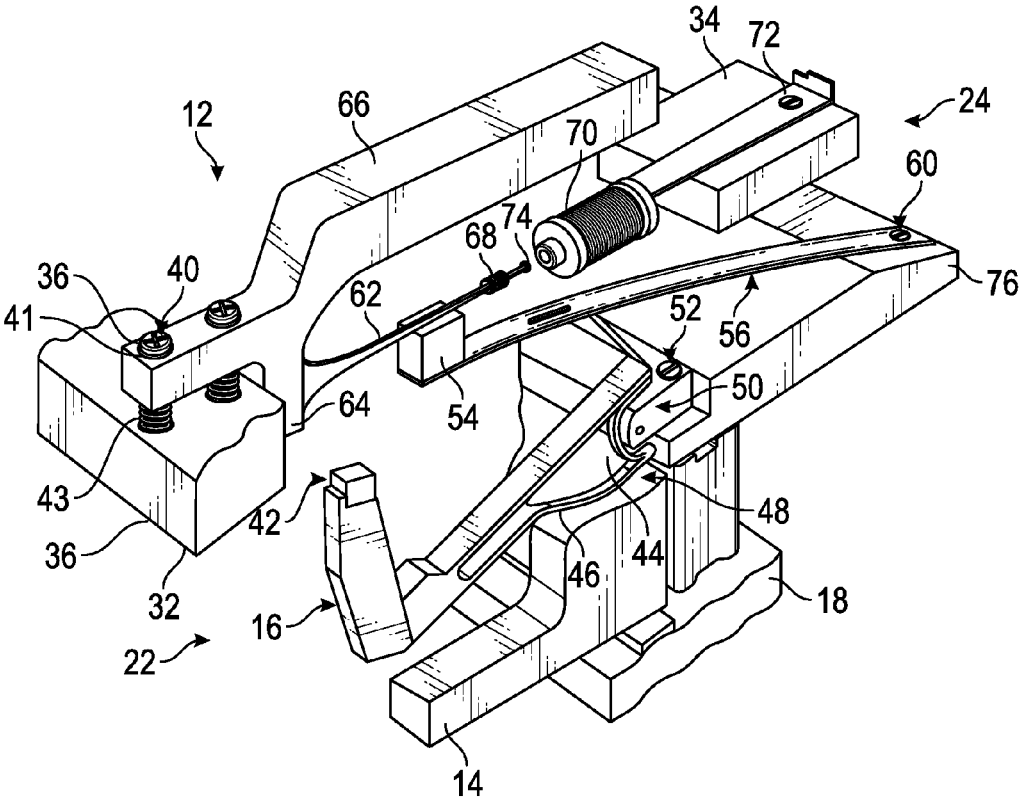
FIG. 2 is an enlarged perspective view of a tine tone generator attached to an electro-mechanical piano, a damper arm, and a hammer prior to the tine tone generator being struck.

FIG. 2 illustrates an enlarged perspective view of a tine tone generator 12 located in the case 20 of the electro-mechanical piano 10. As will be discussed in more detail below, the tine tone generator 12 can be configured to form an asymmetrical tuning fork. The tine tone generator 12 can include a tone bar 66 and a tine 62. As discussed above, one end of the tone bar 66 can include a plurality of holes 36 that allow the tine tone generator 12 to be secured within the case 20 of the electro-mechanical piano 10. Each of the plurality of holes 36 can include a nail 40. In some examples, as illustrated in FIG. 2, each of the nails 40 can include a plurality of grommets 41 that are disposed about the top portion of each of the nails 40 such that the head of the nail 40 is not retained against the surface of the tone bar 66. In some examples, the grommets 41 can be composed of a rubber. Each of the nails 40 can also include a plurality of springs 43 that are disposed about the exposed base of the nails 40. The grommets 41 and springs 43 can allow the tone bar 66 to float between the grommets 41 and the springs 43 such as to take the tension from the nails 40 when the tone bars 66 are vibrated.

In some examples the tine tone generator 12 is oriented such that one end of the tone bar 66 is secured to the proximal cross member 32. The tone bar 66 can extend between the proximal cross member 32 and distal cross member 34. As will be explained below, the tone bar 66 can include a generator portion 64 and a surface of the generator portion 64 can be adjacent to a surface of the proximal cross member 32.

The tine 62 can be a portion of the tine tone generator 12 that can be struck when a key 14 is depressed by a user. In some embodiments, the tine 62 extends perpendicular or substantially perpendicularly from a surface of the generator portion 64 such that it runs parallel or substantially parallel to the direction that the tone bar 66 extends. In some examples, the distal end of the tine 62 can include a tuning spring 68. As will be illustrated below, the tuning spring 68 can be formed from a coil or a spring.

Figure 2A:
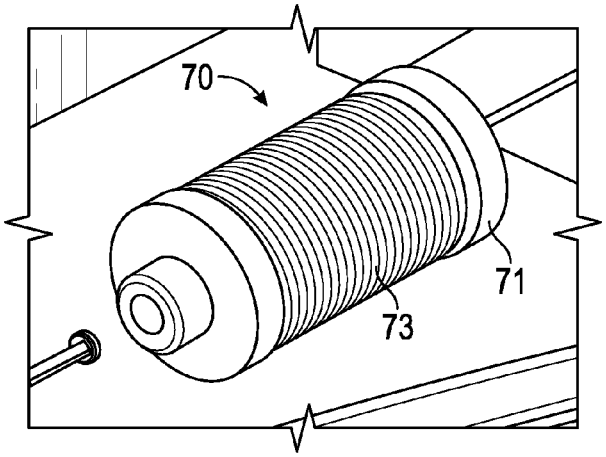
FIG. 2A is an enlarged view of a pickup shown in FIG. 2.

To provide amplification to the sound generated by the tine tone generator 12, the electro-mechanical piano 10 can include a pickup 70 that is located adjacent to the distal end of the tine 62. In some embodiments, the pickup 70 can be a transducer that captures the mechanical vibrations of the tine 62 once it has been struck by the hammer 16. FIG. 2A illustrates an example of the pickup 70. As shown, the pickup 70 can include a magnet 71 and a coil 73 disposed about the surface of the magnet 71. In some examples, the pickup 70 can include an arm that allows it to be secured to the distal cross member 34 with a screw 72. In other embodiments, a microphone is used instead to pick up the sound generated by the tine tone generator 12.

In one arrangement, the pickup 70 can include a casing that serves to support an elongated permanent magnet 71. The magnet 71 can be generally coaxial with the tine 62 with one end closely adjacent the free or distal end of the tine 62. The coil 73 can be wound around the magnet 71 and can be connected by wires to an amplifier (e.g., a guitar amplifier) and/or speaker (e.g., a standard powered speaker) as described herein. As explained herein, the tine 62 can include a magnet or magnetized material such that vibration of the tine 62 alters the field of the magnet 71 and results in generation of a voltage in the coil 73. The voltage in the coil 73 can correspond to the tine vibration and may be amplified and then converted into a sound by a loudspeaker or a guitar amplifier or sound chamber (as described below). While many of the illustrated and described embodiments of the electro-mechanical piano 10 herein include a pickup 70 which can be connected to a speaker, amplifier or sound chamber, in other embodiments of the embodiments described herein the electro-mechanical piano 10 can be made without a pickup and/or speaker, amplifier or sound chamber such that the tines generate the sound of the instrument by themselves without amplification.

The electro-mechanical piano 10 can include a plurality of hammers 16. Each of the tine tone generators 12 can be associated with a separate hammer 16 that is configured to translate depression of one of the keys 14 to striking the tine 62 of the corresponding tine tone generator 12 to produce a note. That is, each key 14 can be associated with its corresponding hammer 16 through a suitable linkage which can be arranged in a variety of configurations. FIG. 2 illustrates one example linkage system. As shown in FIG. 2, the hammer 16 can include a head 42 and a cam 44. The base of the cam 44 can include a curved opening that is configured to pivot about a hammer flange 50 that is secured to a proximal end of a bridge 76 that spans the width of the inside of the case 20. The cam 44 includes a bottom edge 46 that curves convexly away from the key and toward the hammer axis. While at rest, the curved bottom edge 46 of the cam 44 is in contact with the top surface 48 of the distal end of the key 14.

In operation, to generate a sound from the tine tone generator 12, the key 14 can be depressed by the musician, which can cause the distal end of the key 14 to contact the bottom edge 46 of the cam 44. As discussed above, the plurality of keys 14 can extend lengthwise from the proximal end 22 to the distal end 24 of the electro-mechanical piano 10. Each of the keys 14 can be balanced on a pin affixed to the base frame 18 (not pictured). At rest, the length of the key 14 can be positioned at an angle with the proximal end raised and the distal end lowered. As the key 14 is depressed, this can cause the key 14 to pivot about the pin such that the proximal end of the key 14 is lowered and the distal end is raised.

As the key 14 is depressed, the point of contact between the key 14 and the hammer 16 (the top surface 48 of the distal end of the key 14 and the bottom edge 46 of the cam) can move toward the hammer axis and the hammer 16 can be driven upwardly until the head 42 of the hammer 16 strikes the tine 62. Once the hammer 16 completes its throw under its own momentum, it can return to its resting position.

The electro-mechanical piano 10 can optionally include a plurality of dampers 54 for each of the plurality of tine tone generators 12. The damper 54 can serve to control and/or stop the vibration of the tine 62. The damper 54 can include a felt pad 58 that covers the top surface of the damper 54. In some examples, the damper 54 can be attached to the proximal end of a flexible damper arm 56. The distal end of the damper 54 can be attached to the distal end of the bridge 76 using a screw 60.

When the electro-mechanical piano 10 is at rest, the felt pad 58 of the damper 54 can rest against the tine 62 which can effectively mute any vibrations of the tine 62. In some examples, when keys 14 are played, the damper 54 can be raised from the tine 62, thereby allowing the tine 62 to vibrate. Each of the keys 14 can control its own damper 54 assembly. In some embodiments, each of the dampers 54 can be configured to interact with the corresponding key 14 to drop the felt pad 58 of the damper 54 away from the tine 62 when the key 14 is depressed. In some embodiments, as illustrated in FIG. 2, depressing the key 14 can cause the upward movement of the hammer 16. As discussed above, the distal end of the cam 44 of the hammer 16 can pivot about the hammer flange 50, which can be attached to the proximal end of the bridge 76. As the hammer 16 moves upward, the distal end of the cam 44 can move downward, thereby depressing the proximal end of the bridge 76. As the proximal end of the bridge 76 is depressed, the distal end of the bridge 76 can be raised which causes the attached damper arm 56 to move downward. The surface of the damper 54 thereby moves away from the tine 62.

As mentioned above, the illustrated arrangement in FIG. 2 of a suitable linkage between each key 14 and its corresponding hammer 16 and the present disclosure is not intended to be limited to this specific illustrated arrangement of the linkage and/or the damper 54 configuration. Those of skill in the art will recognize that the linkage and/or damper configuration can be configured in many different configurations.

Figure 3:
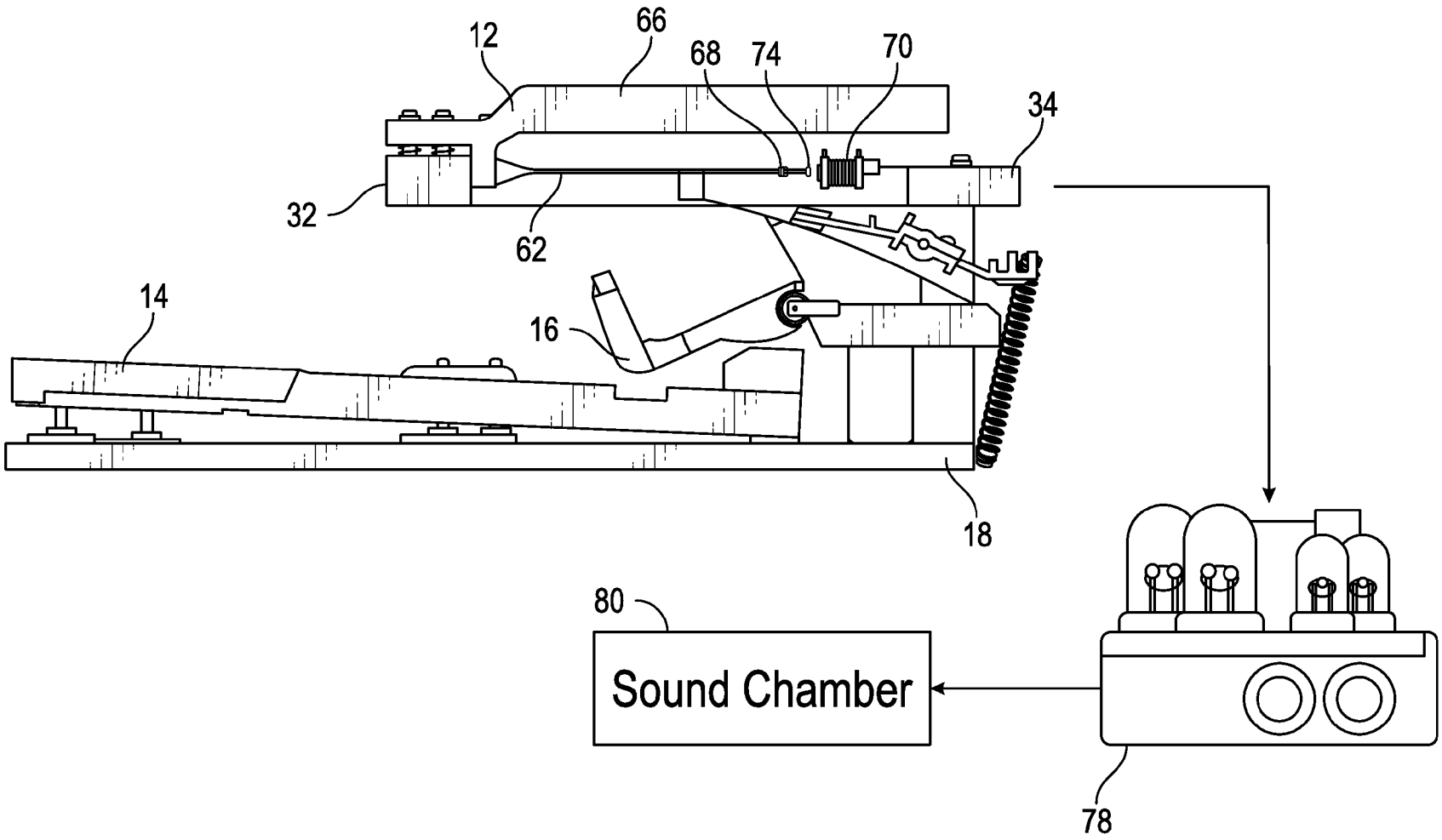
FIG. 3 is a schematic illustration of the path that the sound generated from a tine tone generator travels after the tine of the tine tone generator is struck.

FIG. 3 is a schematic illustration of how sound travels after it is generated from one of the tine tone generators 12 in some embodiments. As is illustrated, after sound is produced by the tine tone generator 12, the resulting vibrations can be captured by the pickup 70. The pickup 70 can then transfer (e.g. through an electrical wire) the oscillation signal to a driver 78. The driver 78 can then mimic the vibration pattern of the vibration of the tine 62 as well as minimize the oscillation received. In some embodiments, instead of a driver 78, a speaker (e.g., a standard powered speaker), a guitar amplifier or an acoustic chamber can be used.

Figure 3B:
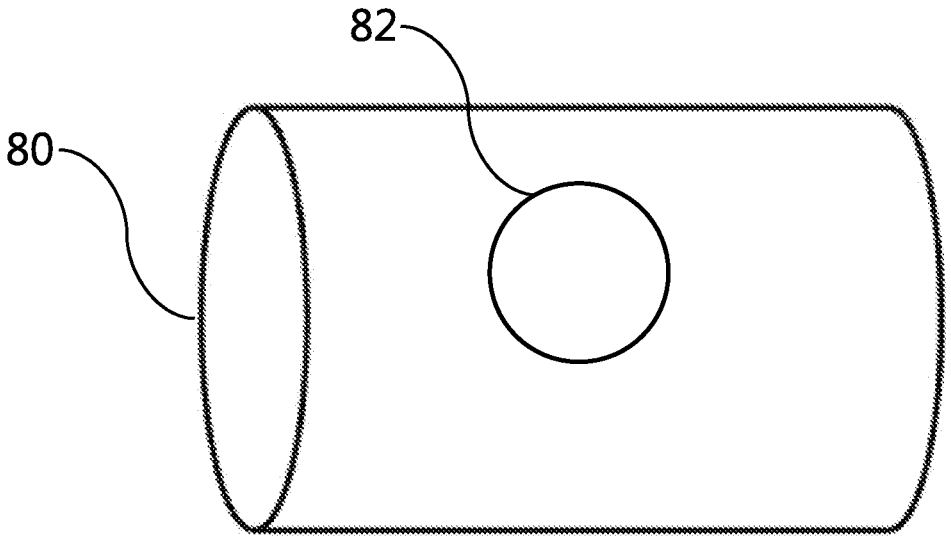
FIG. 3B-D illustrates an enlarged view of an embodiment of the sound chamber in FIG. 3.
Figure 3C:
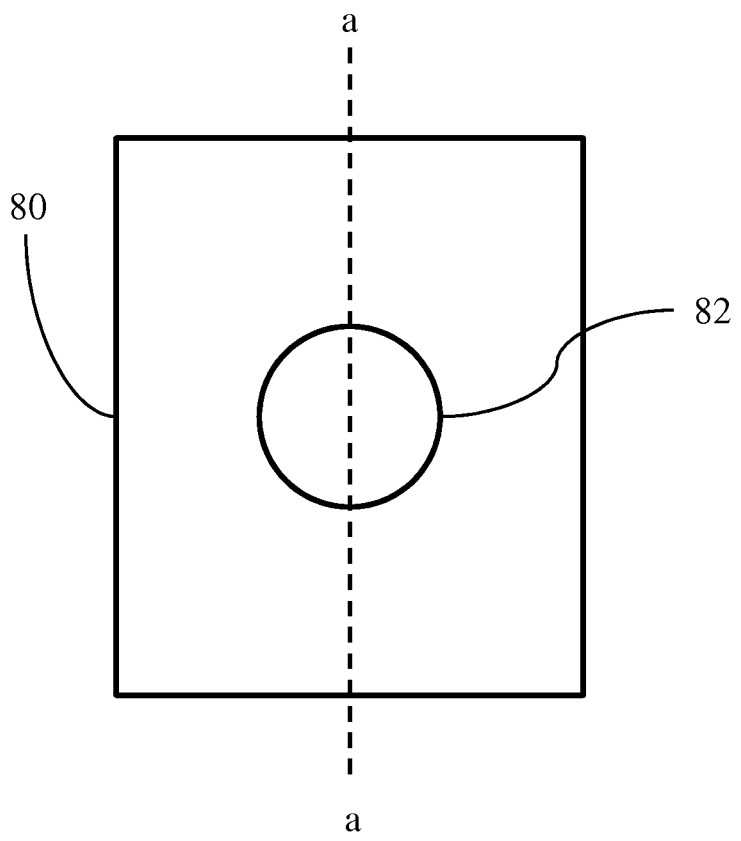
Figure 3D:
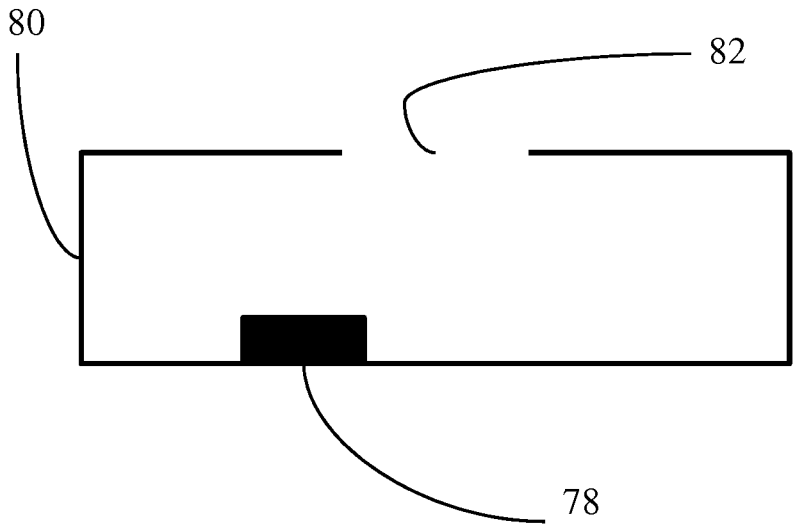

The sound can then transferred to a sound chamber 80 to provide amplification. In some examples, the sound chamber can be made of carbon fiber. FIGS. 3B-D illustrates an embodiment of the sound chamber 80. FIG. 3B illustrates a side perspective view of the sound chamber 80. In certain arrangement, the sound chamber comprises a substantially enclosed box or chamber that defines a substantially enclosed volume.

FIG. 3C illustrates a top view of the sound chamber 80 with tuning port 82. In some examples, depending on the size, the sound chamber 80 can have more than one tuning port 82. In some embodiments, the tuning port 82 can allow the lower base notes of the disclosed instrument to amplify. As well, the tuning port 82 can provide an overall quality for sound as the depth and size variations will affect the treble and base frequency amplification and sound quality control.

FIG. 3D is a cross-sectional view of the sound chamber 80 along the "aa" line. In some examples, the driver 78 can be located within the sound chamber 80 such that the driver vibrates the material of the sound chamber (e.g., carbon fiber material) to provide sound amplification. In some embodiments, the driver can be affixed internally to the bottom of the sound chamber 80 for to provide maximum vibration of the overall enclosure. In other examples, the sound chamber can be made of wood, fiberglass, or ABS. In other examples, speakers (e.g., a standard powered speaker) and/or amplifiers (e.g., a guitar amplifier) can be used to amplify the sound generated from the tine tone generator 12.

The driver 78 and sound chamber 80 can be located and secured in various locations in the electro-mechanical piano 10. For example, the driver 78 and sound chamber 80 can be located in the case 20. In other examples, the driver 78 can be attached to a wall of the electro-mechanical piano 10.

As will be described in more detail below, the tine tone generator 12 can be shaped to form an asymmetric tuning fork. Not unlike a tuning fork, the tine tone generator 12 can produce a very pure tone as very little of the energy is translated into overtones. When the tine 62 of the tine tone generator 12 is struck, the tine 62 can vibrate up and down. In some examples, the tine 62 is located at the base of generator portion 64 which can allow the vibration to transmit to the tone bar 66 and amplify the sound generated by the tine 62.

Once the vibration is generated by the hammer 16 striking the tine 62 of the tine tone generator 12, the pickup 70 can capture the vibration of the tine 62 as described above. In some examples, the pickup 70 is a transducer. The pickup 70 can include magnetic pole pieces with centers that align with the tine 62. The magnetic pickup 70 creates a magnetic field which can be disturbed by the vibration of the magnetic tine 62. The changing magnetic flux can induce a voltage that is transmitted to the amplifier 78.

As described above, in order for the pickup 70 to capture the vibration of the tine 62, the tine 62 or portions thereof are preferably ferro magnetic. In embodiments where the tine 62 is composed of a material that is not sufficiently ferro magnetic, the distal end of the tine 62 can include a ferro magnetic tip 74 (e.g. ferro magnetic paint with steel particles). The ferro magnetic tip 74 can then allow the pickup 70 to sense the vibration of the tine 62. In other embodiments, the ferro magnetic tip 74 can be formed by providing the tine 62 with a separate cap made of a ferro magnetic material.

Tine Tone Generator

Figure 4A:
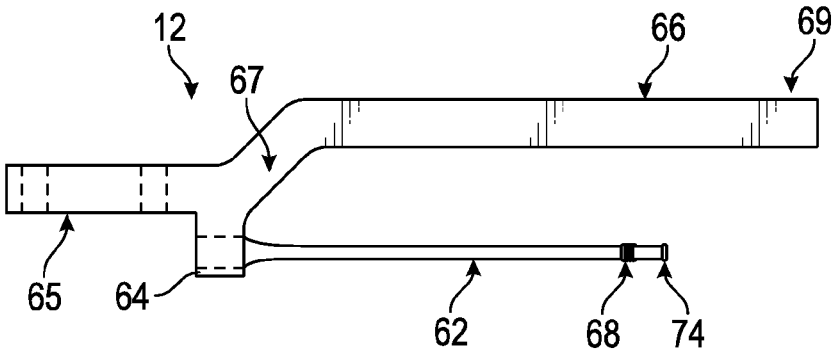
FIGS. 4A-C illustrate a side, frontal, and bottom view of a tine tone generator.
Figure 4B:
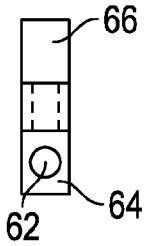
Figure 4C:
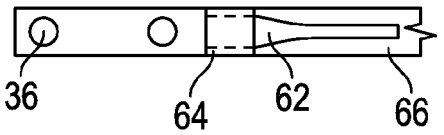
Figure 5A:
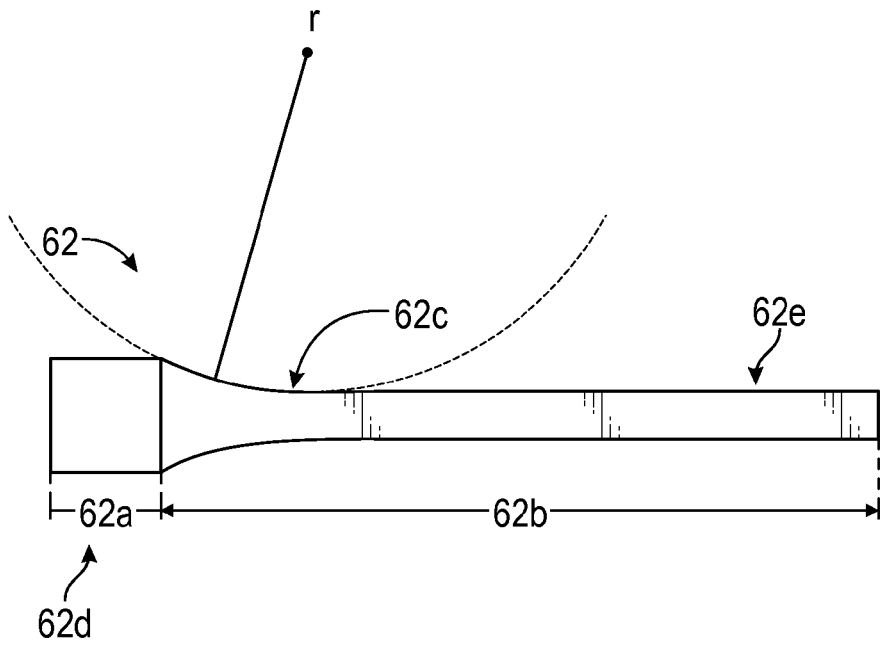
FIGS. 5A-C illustrate a side, frontal, and rear view of the tine of a tine tone generator of FIGS. 4A-C.
Figure 5B:
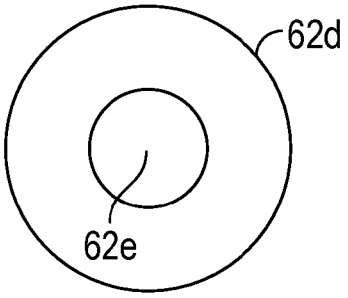
Figure 5C:
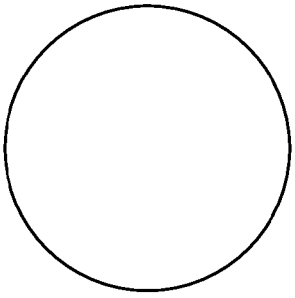
Figure 6A:
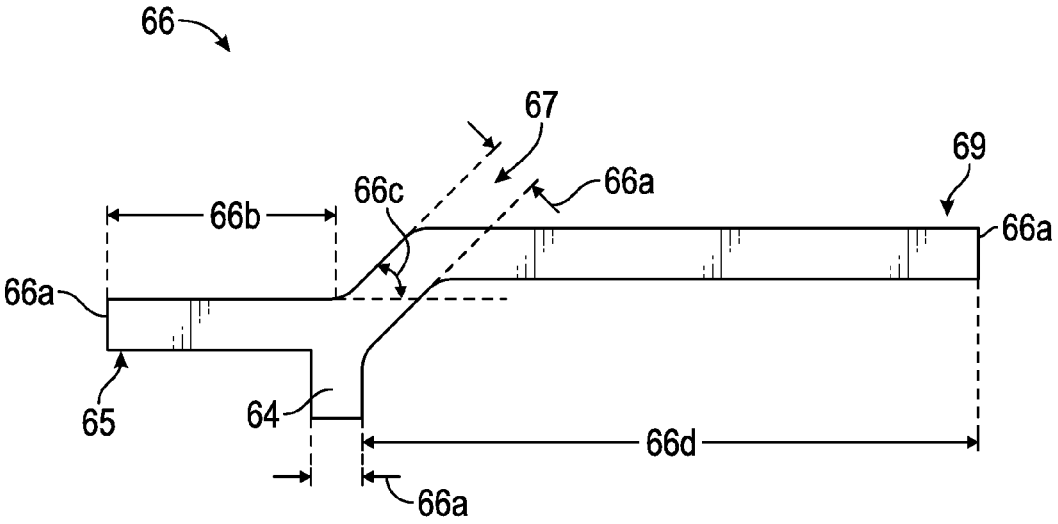
FIGS. 6A-C illustrate a side, frontal, and bottom view of the tone bar of a tine tone generator of FIGS. 4A-C.
Figure 6B:
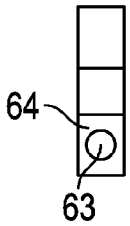
Figure 6C:
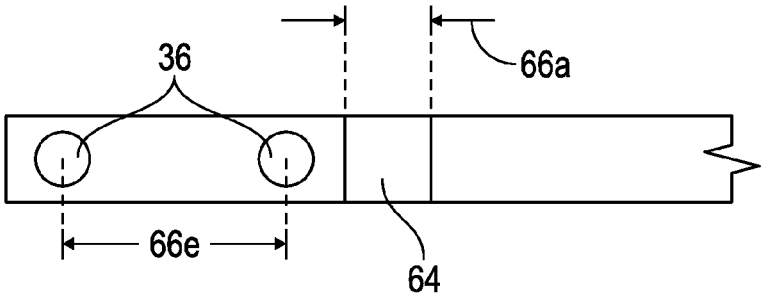

FIGS. 4A-6C illustrate a plurality of views of an embodiment of the tine tone generator 12 and its components. FIGS. 4A-C illustrate a side, frontal and bottom view of an embodiment the tine tone generator 12. FIGS. 5A-B illustrate a side, frontal and rear view of the tine 62 of an embodiment the tine tone generator 12. FIGS. 6A-C illustrate a side, frontal, and bottom view of the tone bar 66 of an embodiment the tine tone generator 12.

The embodiment tine tone generator 12 as illustrated in FIGS. 4A-C can be considered analogous to an asymmetric tuning fork. The tine tone generator 12 can include the tine 62,*d* the tone bar 66, a tuning spring 68, and a ferro magnetic tip 74. Each of these portions will be discussed in turn. FIG.

4A illustrates a side view of the tine tone generator 12. FIG. 4B illustrates a frontal view of the tine tone generator 12. FIG. 4C illustrates a bottom view of the tine tone generator 12.

The illustrated embodiment of the tine tone generator 12 can be configured to provide a purer acoustic sound for a very long sustained duration. The construction of the tine tone generator 12 advantageously allows the produced note to vibrate in resonance. In some examples, a note can vibrate for twenty or more seconds. This can be because the tone bar 66 and the tine 62 are tuned to each other.

An embodiment of the tine 62 is illustrated in FIGS. 5A-C. FIG. 5A illustrates a side perspective of the tine 62 and FIG. 5B illustrates a frontal view of the tine 62 and FIG. 5C illustrates a rear view. The tine 62 can be made from a high strength titanium alloy in an embodiment. In an embodiment, the tine 62 can form a monolithic piece and in another embodiment the tine 62 can form a monolithic piece of titanium. The titanium alloy can allow the tine 62 to vibrate in a straight up and down vertical plane. This vibration can allows the sound given off to be a pure note with little to no distortion or unwanted overtones. The construction and material of the tine 62 can prevent the tine 62 from vibrating in various patterns (e.g. an oval or figure eight) or in a wild or high amplitude manner. This can therefore prevent distortion and overtones that are present.

In some embodiments, the use of titanium in the tine 62 can prevent the tine 62 from failure due to fatigue from repetitive hits by the hammer 16. The titanium of the tine 62 can be less susceptible to fatigue and fracturing because of its superior strength and resistance to corrosion as compared, for example, to tines made of steel. The titanium material can therefore reduce the loss of tone as the tine 62 as repeated striking can weaken the tine over time. The high strength of the titanium can also allow the vibration of the tine 62 to be sustained for a considerably longer period of time than a tine 62 constructed of other materials. In some embodiments, the tine is composed entirely of titanium.

The titanium tine 62 can also produce a note of pure musical quality—particularly for notes in the higher registers. In higher octaves, the tone quality produced by the titanium tine 62 can be superior as the vibration sustained can extend for more than 2 seconds. While titanium is a preferred material for the tine 62, the disclosure is not limited to tines made of titanium. Accordingly, certain features and advantages of the embodiments disclosed herein can be achieved with tines formed of different materials such as steel. Other high strength materials can also be used such as for example aluminum 7075, tin bronze, or carbon steel.

The tine 62 can be made from a rod that is cylindrical and made of titanium. As shown in FIG. 5A, the tine 62 can comprise a proximal portion 62*d*, a distal portion 62*e*, and a tapered portion 62*c* between the proximal and distal portion. In some examples the proximal portion 62*d* of the titanium rod can be about 0.025 inches and can be cylindrical. The tine 62 can be turned such that the distal portion 62*e* that is cylindrical and can have a diameter 62*e* that is less than the proximal portion 62*d* and in one embodiment can be of around an eighth (⅛) of an inch. As illustrated in FIG. 5A, the tine 62 can have the tapered portion 62*c* between the proximal portion 62*d* down to the smaller diameter distal portion 62*e*. In one embodiment, the tapered portion 62*c* has a linear taper. In some examples, the slope of the linear taper can be in the range from 3 to 10 degrees. In other examples, the slope of the linear taper can be 3, 4, 5, 6, 7, 8, 9, or 10 degrees. In another embodiment, the tapered portion 62*c* does not have a linear taper, but instead can have a large radius curve that gently blends to the smaller diameter distal portion 62*e* as shown in FIG. 5A. In some examples, the radius curve for the tine can range from 1.50 to 4.50 inches. In other examples, the radius curve can have a radius curve of 1.50, 1.75, 2.0, 2.25, 2.50, 2.75, 3.0, 3.25, 3.50, 3.75, 4.0, 4.25 or 4.50 inches.

For example, the tapered portion 62*c* can have a cross-sectional radius that varies along the length of the tapered portion 62*c*. In some examples, the tapered portion 62*c* can have a length between 0.10-0.76 inches and a varying cross-sectional radius that ranges between 0.1875-0.0425 inches. In some embodiments, at a length of 0.10 inches, the tapered portion 62*c* can have a cross-sectional radius of between 0.103-0.1875 inches; at a length of 0.20 inches, the tapered portion 62*c* can have a cross-sectional radius of between 0.084-0.103 inches; at a length of 0.30 inches, the tapered portion 62*c* can have a cross-sectional radius of between 0.0705-0.084 inches; at a length of 0.40 inches, the tapered portion 62*c* can have a cross-sectional radius of between 0.0605-0.0705 inches; at a length of 0.50 inches, the tapered portion 62*c* can have a cross-sectional radius of between 0.0525-0.0605 inches; at a length of 0.60 inches, the tapered portion can have a cross-sectional radius of between 0.047-0.0525 inches; at a length of 0.70 inches, the tapered portion can have a cross-sectional radius of between 0.0435-0.047 inches; and at a length of 0.760 inches, the tapered portion can have a cross-sectional radius of between 0.0425-0.0435 inches.

This configuration can allow the vibration to be transmitted with less impedance and distortion into the tone bar 66. In some examples, the length of the tapered portion 62*c* can be around 0.75 inches. In other examples, the length of the tapered portion 62*c* can range from 0.25 to 1.50 inches. In other examples, the length of the tapered portion 62*c* can be 0.25, 0.50, 0.75, 1.0, 1.25, or 1.50 inches.

In some examples, the tine 62 can have a proximal portion length 62*a* (corresponding to a length along the longitudinal axis of the proximal portion 62*d*) of approximately 0.375 inches and length 62*b* (along the longitudinal axis) of the tapered portion 62*c*. The distal portion 62*e* can have varying length between 2.0-7.0 inches. In some embodiments, the distal portion 62*e* can be 2.0 inches, 2.5 inches, 3.0 inches, 3.5 inches, 4.0 inches, 5.0 inches, 6.0 inches, or 7.0 inches. The associated distal end diameter 62*e* can range between 0.080-0.100 inches. In some examples, depending on the note to be produced, each of the aforementioned lengths 62*b* of the tines can be trimmed for each individual note.

The attachment of the tine 62 to the tone bar 66 can be through an interference press fit. This engagement can firmly holds the tine 62 in place and allow for proper transmission of the vibration. A hole 63 can be provided in the generator portion 64 of the tone bar 66 for receiving the proximal portion 62*d* of the tine 62.

Turning next to the tone bar 66 illustrated in FIGS. 6A-C, the tone bar 66 is the complementary side of the asymmetric tuning fork. FIG. 6A illustrates a side perspective view of the tone bar 66, FIG. 6B illustrates a frontal view of the tone bar 66, and FIG. 6C illustrates a bottom view of the proximal end of the tone bar 66. The purpose of the tone bar 66 is to vibrate sympathetically in resonance from the energy of the striking hammer 16 and cause the tine 62 to vibrate, thereby sustaining and providing longevity to the note.

The tone bar 66 can be made from a thick aluminum bar or plate such that the thickness of the tone bar 66 is consistent throughout the body of the tone bar 66. In some examples, the thickness 66*a* of the tone bar 66 is three eighths (⅜) of an inch. The aluminum can be of a high strength variety, such as 7075-T651. As with the tine 62, the strength of the tone bar material is advantageous to the performance of the tine tone generator 12. In materials with lesser strength (such as 6061-T6 aluminum) or materials of a higher strength (such as titanium), the performance of the tone bar 66 can severely degrade. Furthermore, the strength of the tone bar 66 can prevent an "up in pitch" at the end of each note generated. In an embodiment, the tone bar 66 is composed entirely of aluminum such as aluminum of a high strength variety, such as 7075-T651. In an embodiment, the tone bar 66 can form a monolithic piece and in another embodiment can form a monolithic piece of aluminum. The shape of the tone bar 66 can also provide enhanced characteristics to the tine tone generator 12. The tone bar 66 can include the generator portion 64 (mentioned above), a proximal portion 65, an angled portion 67 and a distal portion 69.

The generator portion 64 can form a vertical portion where the tine 62 is attached. In some embodiments, proximal portion 65 branches into the generator portion 64 and the angled portion 67, which forms an angle 66*c* with respect to a longitudinal axis of the proximal portion 65. In some examples, the angle 66*c* formed can be 45 degrees or about 45 degrees, in one embodiment ±15 degrees from about 45 degrees. In other examples, the range of the angle 66*c* formed can range from ±30 degrees from about 45 degrees. The distal portion 69 of the tone bar 66 can then extend past the tine 62 with a length that exceeds the tine 62 length by as much as a factor of two in some embodiments. The body length 66*d* of the angled portion 67 and distal portion 69 past the generator portion 64 can range anywhere from 1.5-16 inches. For example, the body length 66*d* can be 2.50 inches, 3.50 inches, 4.00 inches, 4.75 inches, 5.50 inches, 6.75 inches, 8.00 inches, or 10.50 inches. As discussed above, the tone bar 66 can have a cross-section that has a thickness 66*a* of three eighths (⅜) of an inch. This relatively thick cross-section of the tone bar 66 helps to provide the tine 62 with greater stability. In one embodiment, the tone bar 66 has a square cross-section. Thus, in certain embodiments, the tone bar 66 can have a square cross-section taken perpendicular to the longitudinal axis of the tone bar 66 in which the sides of the square cross-section that is three eighths (⅜) of an inch. In other examples, the cross-section of the tone bar 66 can have a width ranging between ¼ to ½ inches and a height ranging from ¼ to 1 inch.

In one arrangement, the distal portion 69 of the tone bar 65 has a substantially constant cross-sectional shape along the length of the distal portion. 69. In one arrangement, the distal portion 69 of the tone bar 65 has a substantially constant cross-sectional shape and cross-sectional dimensions along the length of the distal portion. 69. With reference back to FIG. 1, in one arrangement, the electro-mechanical piano can include a plurality of tine tone generators 12 in which the tone bars 65 can have different lengths but the distal portion 69 of the tone bar 65 has a substantially constant cross-sectional shape and/or cross-sectional dimensions along the length of the distal portion 69 across a plurality of keys or, in some embodiments, across all of the keys of the instrument. In certain embodiments, the electro-mechanical piano can include a plurality of tine tone generators 12 in which the tone bars 65 can have different lengths but the distal portion 69 of the tone bar 65 has a substantially constant cross-sectional shape and/or cross-sectional dimension along the length of the distal portion. 69 across more than one octave of keys within the instrument.

To attach the tone bar 66 to the electro-mechanical piano 10, the proximal portion 65 of the tone bar 66 can include a plurality of holes 36. The plurality of holes 36 can each accommodate, as discussed above, the grommets 41 and the springs 43 of the nail 40 can firmly retain the tone bar 66 to the electro-mechanical piano 10. In some examples, the proximal end of the tone bar 66 can have two holes 36 and the distance between the holes 66*e* can be approximately 1.00 inches. In some examples, the proximal portion 65 of the tone bar 66 can have a proximal length 66*b* that is 1.562 inches.

With reference to FIG. 4A, in the illustrated embodiment, the proximal portion 65 of the tone bar 66 can extend along a longitudinal axis or direction that extends parallel or substantially parallel to a longitudinal axis or direction of the tine 62. The proximal portion 65 can branch off in a distal direction into the generator portion 64 and the angled portion 67. The angled portion 67 can extend upwardly at first angle or direction with respect to the longitudinal axis or direction of the proximal portion 65. The generator portion 64 can extend away from the angled portion 67 at an angle perpendicular or substantially perpendicular to the longitudinal axis or direction of the proximal portion 65. The distal portion 69 can extend distally from the angled portion along a longitudinal axis or direction that is parallel or substantially parallel to the longitudinal axis or direction of the tine 62.

In some examples, each note in the electro-mechanical piano 10 can be generated by a tone bar 66 of varying length. A tone bar 66 of an improper length can result in a note that vibrates for only six to seven seconds, whereas a properly tuned tone bar 66 can allow the same note to vibrate for over twenty seconds. Lower notes can require bigger tone bars 66 and a bigger associated tine 62.

The length of the tone bar can be calculated using the equations discussed in more detail below. For example, using 7075-T6511 aluminum and a tone bar 66 with a cross-section of 0.375 inches by 0.375 inches, the length of the tone bar 66 can be calculated using the following equation: 109.65 divided by the square root of the frequency (f). Using this example, to build a tone bar 66 that produces an "A" note on the zero octave range, a frequency of 27.50 Hz is required. Using the aforementioned calculation, the tone bar 66 is computed to be 20.90 inches.

Turning back to FIG. 4A, the tine tone generator 12 can further include a tuning spring 68. The tuning spring 68 can be slipped onto the shaft of the tine 62. In some examples, the tuning spring 68 can be deformed in the middle to grab onto the outside surface of the tine 62. In some examples, the tuning spring 68 can be adjustable along the outside surface of the tine 62. By moving the tuning spring 68 along the surface of the tine 62, the tuning spring 68 can be used to precisely tune the tine 62 to the exact frequency required for the note. In some examples, the tuning spring 68 can have a grip on the tine 62 great enough to prevent it from moving regardless of how many times the note has been played. Once the tine tone generator 12 is tuned to a particular note, it stays in tune and does not have to be re-tuned.

The tine tone generator 12 can also include a ferro magnetic tip 74 as illustrated in FIG. 4A. As discussed above, in order for the pickup 70 to track the motion of the tine 62, the tine 62 is preferably made of a ferro magnetic material. However, in instances where the tine 62 is made of a non-magnetic material (e.g. titanium), the distal end of the tine 62 can include a ferro magnetic tip 74. In some examples, ferro magnetic paint can be used to form the ferro magnetic tip 74, and/or a ferromagnetic cap or sleeve be attached to the distal tip of the tine 62.

Tine Sizing

As discussed above, the tine tone generator 12 resembles an asymmetrical tuning fork. The frequency of a tuning fork depends on its dimensions and the material from which it is made. To ensure that the tine tone generator 12 behaves as a tuning fork, the size of the tine 62 can be calculated using the formula provided below.

Frequency for a tuning fork can be calculated using the formula below:

$$f = \frac{1.875^2}{2\pi l^2}\sqrt{\frac{EI}{\rho A}}$$

wherein f is the frequency of the fork; l is the length of the tine, E is Young's modulus of the material the fork is made of, I is the second moment of area of the cross-section of the fork, ρ is the density of the material the fork is made of, and A is the cross-sectional area of the tine.

Density (ρ) can be further expressed as specific weight (γ) divided by the acceleration of gravity (g). Frequency can therefore be calculated as:

$$f = \frac{1.875^2}{2\pi l^2}\sqrt{\frac{EIg}{\gamma A}}$$

To simplify and substitute the diameter (d) into this equation, we can use the following numerical relationships:

$$I = \frac{\pi}{64}d^4$$

$$A = \frac{\pi}{4}d^2$$

$$\frac{I}{A} = \frac{d^2}{16}$$

The formula for calculating frequency can therefore be modified to the following:

$$f = \frac{1.875^2}{2\pi l^2}\sqrt{\frac{Egd^2}{\gamma(16)}}$$

A tine 62 can be therefore be configured to act as a tuning fork if it has the diameter and length that satisfies the formula above. An example calculation for the diameter and length of the tine 62 is provided below wherein:

$$\gamma = 279(\text{lb}/\text{ft}^3)\times\frac{1}{12^3}(\text{ft}^3/\text{inch}^3) = 0.1615(\text{lb}/\text{inch}^3)$$

$$E = 16.5(10^6)(\text{lb}/\text{inch}^2)$$

$$g = 32.2(\text{ft}/\text{sec}^2)\times 12(\text{inch}/\text{ft}) = 386.4(\text{inch}/\text{sec}^2)$$

Therefore:

$$\therefore f = \frac{1.875^2}{2\pi l^2}\sqrt{\frac{16.5\times 10^6(\text{lb}/\text{inch}^2)\times 386.4(\text{inch}/\text{sec}^2)\times d^2(\text{inch}^2)}{0.1615(\text{lb}/\text{inch}^3)\times(16)}} = 27,793\frac{d}{l^2}$$

The relationship between the length and diameter of the tine 62 and the produced frequency can be defined as:

$$l = 166.71\sqrt{\frac{d}{f}}$$

Using the above relationship, the table below provides some example diameters and lengths of the tine 62 required to achieve certain frequencies:

| f | d | l |
|---|---|---|
| 73.4 | 0.115 | 6.60 |
| 73.4 | 0.125 | 6.88 |
| 73.4 | 0.105 | 6.30 |
| 49 | 0.115 | 8.07 |

In some examples, an additional 0.30 inches can be added to the length of the tine 62 to account for the taper.

As discussed above, in some examples, the tine 62 can include a tuning spring 68 and a ferro magnetic tip 74. Adding these features can lower the tone by as much as four notes. For example, B3 (f=247 Hz) is lowered to approximately G#3 (f=208 Hz) or about 16%.

Waveforms—

Figure 7A:
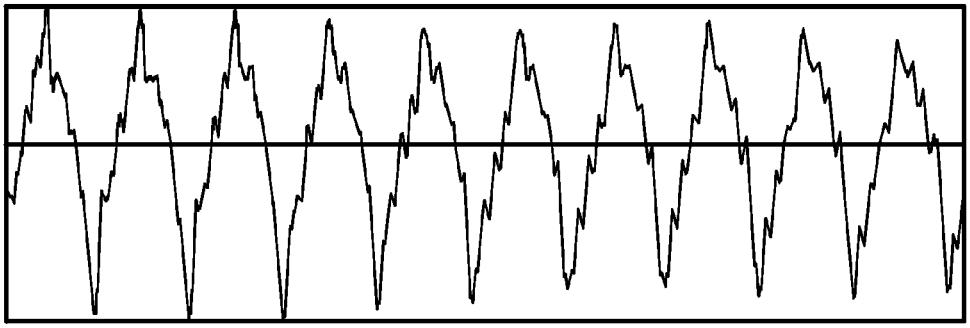
FIGS. 7A-C illustrate a comparison of waveforms of an F4 note produced by a Steinway grand piano (FIG. 7A), a Rhodes piano (FIG. 7B), and an embodiment of a tine tone generator of FIGS. 4A-C (FIG. 7C).
Figure 7B:
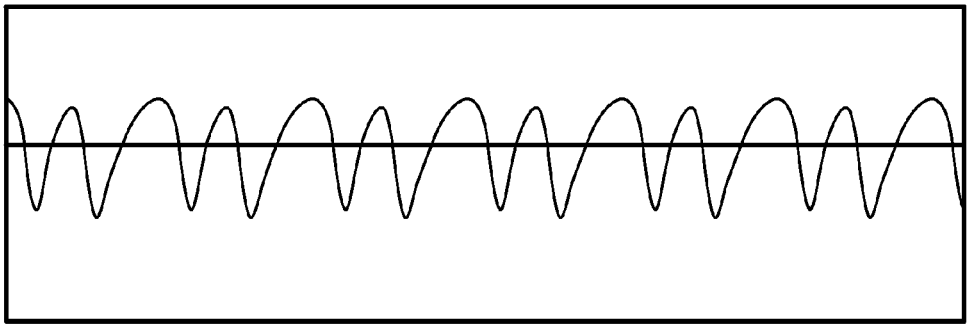
Figure 7C:
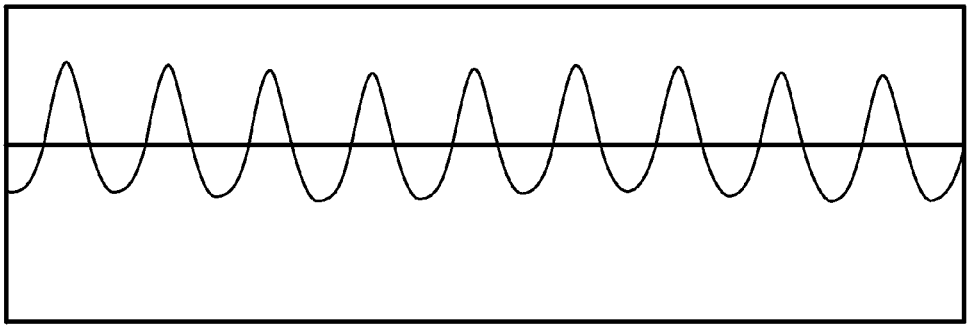

As discussed above, the configuration of the tine tone generator 12 discussed above can produce a sound with minimal distortion or overtones. FIGS. 7A-C illustrate a comparison of the waveforms produced by a Steinway grand piano (FIG. 7A), a Rhodes piano (FIG. 7B), and a piano using an embodiment of the tine tone generator 12 presently disclosed (FIG. 7C) when the F4 note is played. FIGS. 7A-C illustrate a number of differences between waveforms produced by embodiments of the presently disclosed instrument and those produced by other instruments. Various aspects of these differences can be described in many ways, including by using words or mathematical relationships, some of which are described below. As can be seen, the waveform generated from the Steinway Grand Piano in FIG. 7A is a very uneven sine wave with substantial noise. The Rhodes Electric Piano, illustrated in FIG. 7B, while improved, still shows a fairly uneven sine wave. The sound wave produced by the tine tone generator 12 is can be less uneven and can more closely resembles a sine wave.

Figure 8A:
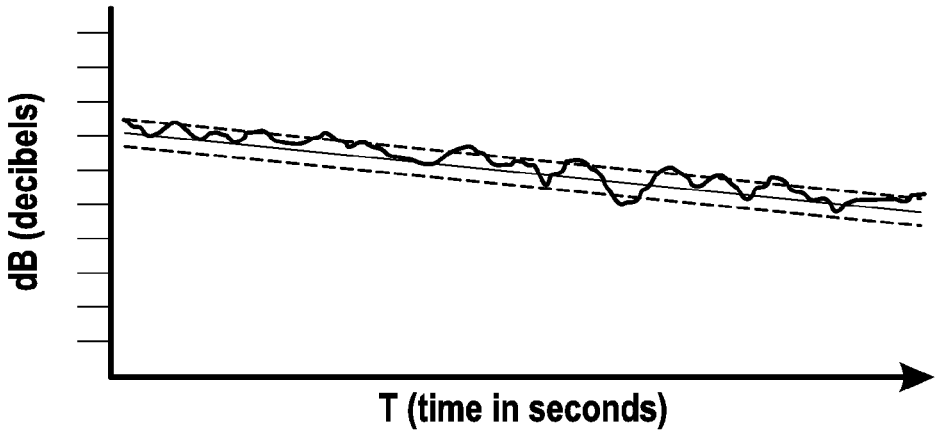
FIGS. 8A-B illustrate a comparison of the decibel decay of an F#3 (third octave) on a standard piano (FIG. 8A) compared to the decibel decay of an F#3 (third octave) on an embodiment of a tine tone generator of the FIGS. 4A-C (FIG. 8B).
Figure 8B:
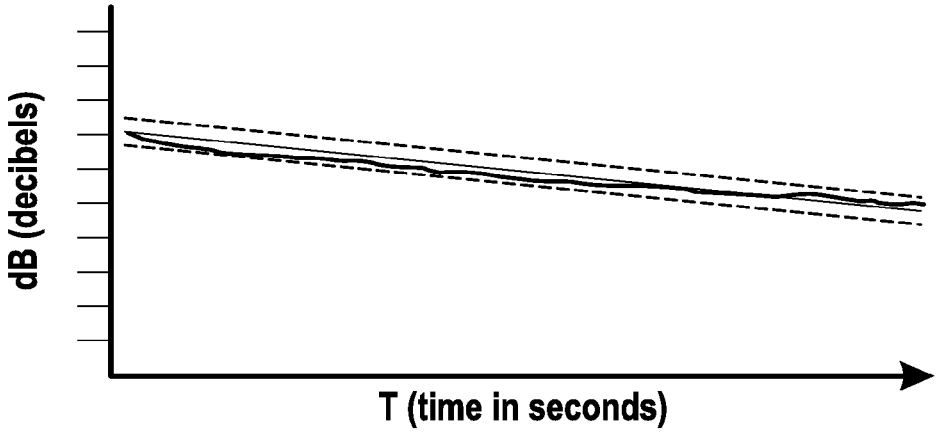

FIGS. 8A-B further illustrate the decibel decay of a note when played on a standard piano and when generated on an embodiment of a tine tone generator of an embodiment of the presently disclosed instrument. FIG. 8A illustrates the decibel decay of a F#3 (third octave) on a standard piano while FIG. 8B illustrates the decibel decay of a F#3 (third octave) on an embodiment tine tone generator of the presently disclosed instrument. FIGS. 8A-B illustrate a number of differences between decay produced by embodiments of the presently disclosed instrument and those produced by other instruments. Various aspects of these differences can be described in many ways, including by using words or mathematical relationships, some of which are described below. FIGS. 8A-B show a decay with a substantially linear slope, as illustrated in the line of best fit. As shown in FIG. 8B, the note generated on an embodiment the disclosed tine tone generator shows fewer decibel oscillations than a comparative note generated on the standard piano. In some examples, the oscillations in decibel on the presently disclosed tine tone generator is between 1 to 5% decibels from the line of best fit of the decibel decay of a generated note. In other examples, the oscillations in decibel on the presently disclosed tine tone generator is less than 2.5% from the line of best fit of the decibel decay of a generated note.

The comparison generated in FIGS. 8A and 8B were produced using a decibel meter. In some examples, the decibel meter can be a mobile phone application such as "Decibel 10th: Pro Sound Meter", SkyPaw Co., Ltd. First, to generate the graph in FIG. 8A, a note on a standard piano is struck while the decibel meter is held 1 foot away from the sound generating portion of piano. Second, to generate the graph in FIG. 8B, a note on the tine tone generator of an embodiment of the presently disclosed instrument is struck while the decibel meter is held 1 foot away from the sound chamber.

As discussed above, the properties of the tine tone generator can generate a sound that has little to no distortion or unwanted overtones. Therefore, in some examples, the presently disclosed tine tone generator can generate a note that can be sustained for a much longer period than a comparative note produced on a standard piano. In some examples, the audible sound produced by an individual playing the embodiments of the presently disclosed instrument (particularly the tine tone generator) can be 25-150% longer in duration than a corresponding note on a standard piano. In some examples, the audible sound produced by an individual playing the presently disclosed device is 30% longer in duration than a corresponding note on a standard piano.

In some examples, each note of the presently disclosed instrument can be associated with an individual tine tone generator. This can reduce the overtones produced, particularly in the higher ranges of the presently disclosed instrument. In a standard piano, each note can require 1, 2, or 3 strings per note. The top 56 notes—from the top treble side to the F3 third octave—requires three strings per hammer. The next 18 notes—from E3 to B1—require two strings per hammer. Only the bottom 14 notes—from A#1 to the base section A0—have a single string per hammer. The reason for the increase of strings in the higher notes is to compensate for the thinner shorter strings composing these higher notes. In notes where multiple strings are used, each of the strings must be tuned perfectly with each other. However, if the strings are even slightly out of tune, the frequency of the vibration of each of the strings can interfere with their neighbors and produce a wavering or overtone in the sound generated. Because the presently disclosed device uses only a single tine tone generator for each note, the sound produced has a significantly reduced wavering and significantly reduced overtones. This is particularly evident in the higher notes of the presently disclosed instrument.

The terms "approximately," "about," and "substantially" as used herein represent an amount close to the stated amount that still performs a desired function or achieves a desired result. For example, in some embodiments, as the context may dictate, the terms "approximately", "about", and "substantially" may refer to an amount that is within less than or equal to 10% of the stated amount in certain embodiments, or within 5%, in certain embodiments or within 1% in certain embodiments The term "generally" as used herein represents a value, amount, or characteristic that predominantly includes, or tends toward, a particular value, amount, or characteristic.

For purposes of summarizing the inventions disclosed herein and the advantages achieved over the prior art, certain objects and advantages of the inventions are described herein. Of course, not all such objects or advantages need to be achieved in accordance with any particular embodiment. Thus, for example, those skilled in the art will recognize that the inventions may be embodied or carried out in a manner that achieves or optimizes one advantage or group of advantages as taught or suggested herein without necessarily achieving or optimizing other objects or advantages as may be taught or suggested herein.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. Similarly, omission of conditional language does not indicate that a described feature is a necessary requirement of a disclosed embodiment or the disclosed musical instrument. For example, as described above, the tine 62 can optionally include a tuning spring 68 or a ferro magnetic tip 74. In other examples, each of the nails 40 of the tine tone generators 12 can optionally include the plurality of grommets 41 and/or springs 43 that can help the tone bar 66 float on the nails 40.

Discussion of the various embodiments herein has generally followed the embodiments schematically illustrated in the figures. Many variations and modifications may be made to the herein-described embodiments, the elements of which are to be understood as being among other acceptable examples. All such modifications and variations are intended to be included within the scope of this disclosure. For example, it is contemplated that the particular features, structures, or characteristics of any embodiments discussed herein may be combined, or form sub-combinations in any suitable manner in one or more separate embodiments not expressly illustrated or described. Accordingly, although the present teachings have been described with reference to these specific embodiments, the descriptions are intended to be illustrative and are not intended to be limiting. Various modifications and applications may occur to those skilled in the art without departing from the spirit and scope of the teachings described herein.

What is claimed is:

1. A musical instrument including:

a keyboard, wherein the keyboard includes a plurality of keys across more than one octave;

a plurality of tine tone generators, wherein each of the plurality of tine tone generators comprises a tone bar and a tine, wherein each tone bar is comprises a single unitary piece, and each of the tone bars comprising a proximal portion, a generator portion, an angled portion, and a distal portion having a length, the proximal portion branching off in a distal direction into the generator portion and the angled portion, the angled portion extending upwardly at first angle that is less than 90 degrees with respect to a longitudinal axis of the proximal portion, the generator portion extending away from the angled portion at an angle substantially perpendicular to the longitudinal axis of the proximal portion, and the distal portion extending distally from the angled portion along a longitudinal axis that is substantially parallel to a longitudinal axis of the tine, the tone bars having a constant cross-sectional shape along the length of the angled portion and the distal portion, and across more than one octave the distal portions of the tone bar have the same cross-sectional shape; and wherein each of the plurality of keys correspond with one of each of the plurality of tine tone generators a plurality of hammers, wherein each of the plurality of hammers is configured to strike the tine of one of the plurality of tine tone generators when one of the plurality of keys is depressed.

2. The musical instrument of claim 1, wherein the tine tone generator includes a tine made of a first material and a tone bar made of a second material that is different than the first material.

3. The musical instrument of claim 2, wherein the tine is comprises of a titanium alloy.

4. The musical instrument of claim 2, wherein the tone bar is comprises of aluminum.

5. The musical instrument of claim 1, wherein the tine includes a tuning spring disposed about the tine.

6. The musical instrument of claim 1, wherein the musical instrument further includes a pickup.

7. The musical instrument of claim 1, wherein the musical instrument further includes a microphone.

8. The musical instrument of any one of claim 7, wherein the musical instrument further includes an amplifier.

9. The musical instrument of claim 8, wherein the amplifier is a speaker.

10. The musical instrument of claim 8, wherein the amplifier is an acoustic chamber.

11. A tine tone generator for an electric piano including:

a tone bar, wherein the tone bar includes a proximal portion for connecting the tone bar to a support surface, a generator portion that extends substantially perpendicularly from the bottom surface of the proximal portion, an angled portion and distal portion, the proximal portion having a longitudinal axis that extends in a first direction and the angled portion extending distally from the proximal portion at a first angle that is less than 90 degrees with respect to the longitudinal axis of the proximal portion, the distal portion bending from the angled portion to extend distally in a second direction that is substantially parallel to the first direction; and a tine that extends distally from a surface of the generator portion in a third direction that is substantially parallel to the second direction.

12. The tine tone generator of claim 11, further including a tuning spring, wherein the tuning spring is formed from coiled wire and is disposed about an outer surface of the tine.

13. The tine tone generator of claim 11, wherein the tine includes a magnetic tip.

14. The tine tone generator of claim 11, wherein the tine is comprises of a titanium alloy.

15. The tine tone generator of claim 11, wherein the tone bar comprises of aluminum.

16. The tine tone generator of claim 11, wherein the first angle is a 45 degree angle.

17. The tine tone generator of claim 11, wherein the tine includes a taper where the tine is attached to the generator.

18. The tine tone generator of claim 11, wherein the tone bar has a uniform thickness of ⅜ of an inch.

19. The tine tone generator of claim 11, wherein the tone bar extends past the tine.

20. An electromechanical piano incorporating both vibratory device and electronic device to generate the desired sounds, said piano comprising:

a plurality of keys;

a plurality of hammers, each hammer associated with at least one key;

a plurality of tines associated with at least one hammer that is associated with at least one key, each tine configured to vibrate in response to striking of a portion thereof by an associated hammer, each tine having a longitudinal axis;

a linkage that causes an associated hammer to strike an associated tine in response to striking associated key; and a plurality of tone bars, each tone bar coupled to one of the plurality of tines, each of the plurality of tone bars comprising a proximal portion, a generator portion, a angled portion, and a distal portion, the proximal portion having a longitudinal axis extending substantially parallel to the longitudinal axis of the tine and branching off in a distal direction into the generator portion and the angled portion, the angled portion extending upwardly at first angle with respect to the longitudinal axis of the proximal portion, the generator portion extending away from the angled portion at an angle substantially perpendicular to the longitudinal axis of the proximal portion, and the distal portion extending distally from the angled portion along a longitudinal axis that is substantially parallel to the longitudinal axis of the tine.

21. The electromechanical piano of claim 20, wherein the first angle is between 30 and 60 degrees.

22. The electromechanical piano of claim 21, wherein the first angle is 45 degrees.

23. The electromechanical piano of claim 20 wherein the proximal portion, angled portion, generator portion and distal portion form a monolithic piece of material.

24. The electromechanical piano of claim 23, wherein the monolithic piece of material is aluminum.

25. The electromechanical piano of claim 20, wherein the proximal portion, angled portion, generator portion and distal portion with have a constant cross-section.

26. The electromechanical piano of claim 25, wherein the cross-section is square.

* * * * *